US006783449B2

(12) United States Patent
Inoue

(10) Patent No.: US 6,783,449 B2
(45) Date of Patent: Aug. 31, 2004

(54) GRINDING TOOL

(76) Inventor: Tamio Inoue, 4-18-1 Maenami-cho, Kasugai, Aichi (JP)

( * ) Notice: Subject to any disclaimer, the term of this patent is extended or adjusted under 35 U.S.C. 154(b) by 206 days.

(21) Appl. No.: 09/990,491

(22) Filed: Nov. 20, 2001

(65) Prior Publication Data

US 2002/0065030 A1 May 30, 2002

(30) Foreign Application Priority Data

Nov. 24, 2000 (JP) ..... 2000-357096

(51) Int. Cl.[7] ..... B24B 5/06
(52) U.S. Cl. ..... 451/462; 451/478; 408/27
(58) Field of Search ..... 451/478, 462, 451/461, 70, 69, 71; 408/27

(56) References Cited

U.S. PATENT DOCUMENTS 3,405,049 A * 10/1968 Czubak ..... 451/462
5,088,237 A * 2/1992 Nagel et al. ..... 451/478
5,417,525 A * 5/1995 Lenhart ..... 408/24
5,482,498 A * 1/1996 Higashikawa ..... 451/61
6,139,414 A * 10/2000 Domanski et al. ..... 451/471

FOREIGN PATENT DOCUMENTS

| | | | |
|---|---|---|---|
| DE | 578112 | * 6/1933 | ..... 451/478 |
| JP | 64-56905 | 4/1989 | |
| JP | 3-1717 | 1/1991 | |
| JP | 3005414 | 10/1994 | |
| JP | 6-297212 | 10/1994 | |

* cited by examiner

*Primary Examiner*—Robert A. Rose
(74) *Attorney, Agent, or Firm*—Kilyk & Bowersox, P.L.L.C.

(57) ABSTRACT

The present invention enables continuous working including working inner diameters with high efficiency. Working members 30, 40 are installed to be able to be attached to and removed from a front end of the tool main body 10 configured with a grinding member 13 on a portion of the axial direction. The working member 30 consists of a grinding reamer, the installation of which enables hole processing followed by inner diameter processing in one continuous operation. The working member 40 consists of a rotating brush, the installation of which enables inner diameter processing followed by inner surface brushing in one continuous operation.

8 Claims, 5 Drawing Sheets

PRIOR ART (b)

PRIOR ART

GRINDING TOOL

BACKGROUND OF THE INVENTION

1. Field of the Invention

The present invention relates to a grinding tool which is inserted to a round hole provided in a subject to be worked while rotating so as to grind the inner surface of the round hole, for the purpose of adjusting the inner diameter of the round hole or the like.

2. Prior Art

As this kind of grinding tool, a grinding tool in which a part in the axial direction of the tool is structured such as to be expandable and the outer diameter of the tool can be adjusted very precisely and simply due to such expansion has been described in Japanese Utility Model Registration gazette No. 3005414. A structure of the conventional grinding tool is shown in FIG. 4.

The grinding tool is constituted by a tool main body 1 in which a front end portion is formed in a cylindrical shape, and an expanding member 3 which is press-fitted within a cylinder portion 2 of the tool main body 1 so as to expand the cylinder portion 2. Abrasive grains such as diamond powders or the like are adhered to the outer surface of the cylinder portion 2 in the tool main body 1 so as to form a grinding portion. The inner surface of the cylinder portion 2 forms a taper surface in which the inner diameter gradually reduces toward a rear end. A slit 4 in the axial direction is provided at a plurality of positions in a circumferential direction of the cylinder portion 2 except a front end portion and a base end portion. The expanding member 3 has an expanding head 5 which is press-fitted within the grinding portion, and a bolt 6 which is screwed to a depth surface of the cylinder portion 2 for said press-fitting.

The grinding portion of the tool main body 1 can be expanded by a plurality of slits 4, and the outer diameter thereof is adjusted very precisely and simply on the basis of a movement in the axial direction of the expanding head 5 caused by screwing the bolt 6. Furthermore, in order to smoothly perform work, the outer diameter of the grinding portion is made slightly larger than the outer diameter of the other portions.

Issues to be Solved by the Invention

The grinding tool shown in FIG. 4 can grind to a high inner diameter precision the inner surface of the round hole provided in a subject material to be worked by fine adjustments of the outer diameter of the grinding portion.

Generally, however, the process using the conventional grinding tool, including this grinding tool, requires processing the round hole by grinding reamer 8 in the subject to be worked 7 before inner surface grinding by the grinding tool, as shown in FIG. 5(*a*). Furthermore, after the inner surface of the round hole is ground, the inner surface is generally brushed by brush 9 to remove grinding particles, as shown in FIG. 5(*b*).

In other words, even the high precision grinding tool shown in FIG. 4 requires as does the common grinding tool the three processes of creating the hole, grinding the inner surface, and brushing the inner surface in order to perform the process as a series, including inner surface grinding, and hence it has not been possible to reduce processing man-hours and processing time.

The present invention is made by taking the matters mentioned above into consideration, and an object of the present invention is to provide a highly efficient grinding tool which can reduce processing man-hours and processing time required to process the series, including inner surface grinding.

SUMMARY OF THE INVENTION

Method of Solving the Issues

In order to achieve the object mentioned above, in accordance with the present invention, there is provided a grinding tool inserted to a hole provided in a subject to be worked while rotating so as to grind the inner surface of the hole, comprising: a tool main body in which abrasive grains such as diamond powders or the like are adhered to at least a part of the outer surface in the axial portion, and that portion serves as the grinding portion, and a working member in which a working portion is provided in the front portion to perform working processes before or after grinding of the inner surface in the subject to be worked and a rear portion that is combined to the tool main body be able to be attached thereto and removed therefrom in such a way as to maintain the working portion to the front end side of the tool main body.

The working member given here has, for example, a grinding reamer or a rotating brush. By the installation of the grinding reamer as a working member in the front end portion of the tool main body and upon processing the hole by the grinding reamer, the grinding process of the inner surface can be done by the grinding portion of the tool main body in a continuous maimer. Furthermore, by the installation of the rotating brush, upon the grinding process of the inner surface by the grinding portion of the tool main body, the brushing of the inner surface can be done in a continuous manner.

As for the tool main body, it is preferred that at least the front end portion in the axial direction is formed in a cylindrical shape, slits in the axial direction are provided in a part in the axial direction of the cylinder portion at a predetermined interval in a circumferential direction, abrasive grains such as diamond powders or the like are adhered to the outer surface thereof so as to form an expandable grinding portion in part of the axial portion, and an expanding member press-fitted within the grinding portion to expand the grinding portion, thereby adjusting the outer diameter of the grinding portion.

The advantages of the tool main body are not only that it is capable of adjusting the outer diameter of the grinding portion with high accuracy by moving the expanding member in the axial direction, but also because the front end portion is formed as a cylinder, using the cylindrical part it can be combined in a simple fitting mechanism including screwing the working member in the main body front end.

For example, providing a female screw portion in the inner surface of the front end portion of the cylindrical portion of the tool main body, the male screw portion to be screwed into the female screw portion is provided in the outer surface of the back portion of the working member, and with the working portion provided to the front portion of the working member, the working member can be easily combined to or removed from the front end portion of the tool main body by screwing.

Furthermore, by matching the screwing of this working tool, the male screw portion to be screwed into the female screw portion of the tool main body is provided in the outer surface of the front portion of the expanding member, and with the expanding head to be press-fitted in the grinding portion of the tool main body provided in the rear portion of the expanding member, the movement of the expanding portion in the axial direction can be performed with a simple mechanism using the male screw portion of the tool main body.

The tool main body is preferably structured such that the inner surface of the grinding portion is constituted by a taper surface which has a diameter which is gradually reduced toward the rear end side, and the grinding portion is expanded on the basis of the movement of the expanding head press-fitted within the grinding portion in the axial direction. In accordance with this structure, it is possible to simplify the expanding mechanism.

Figure 1:
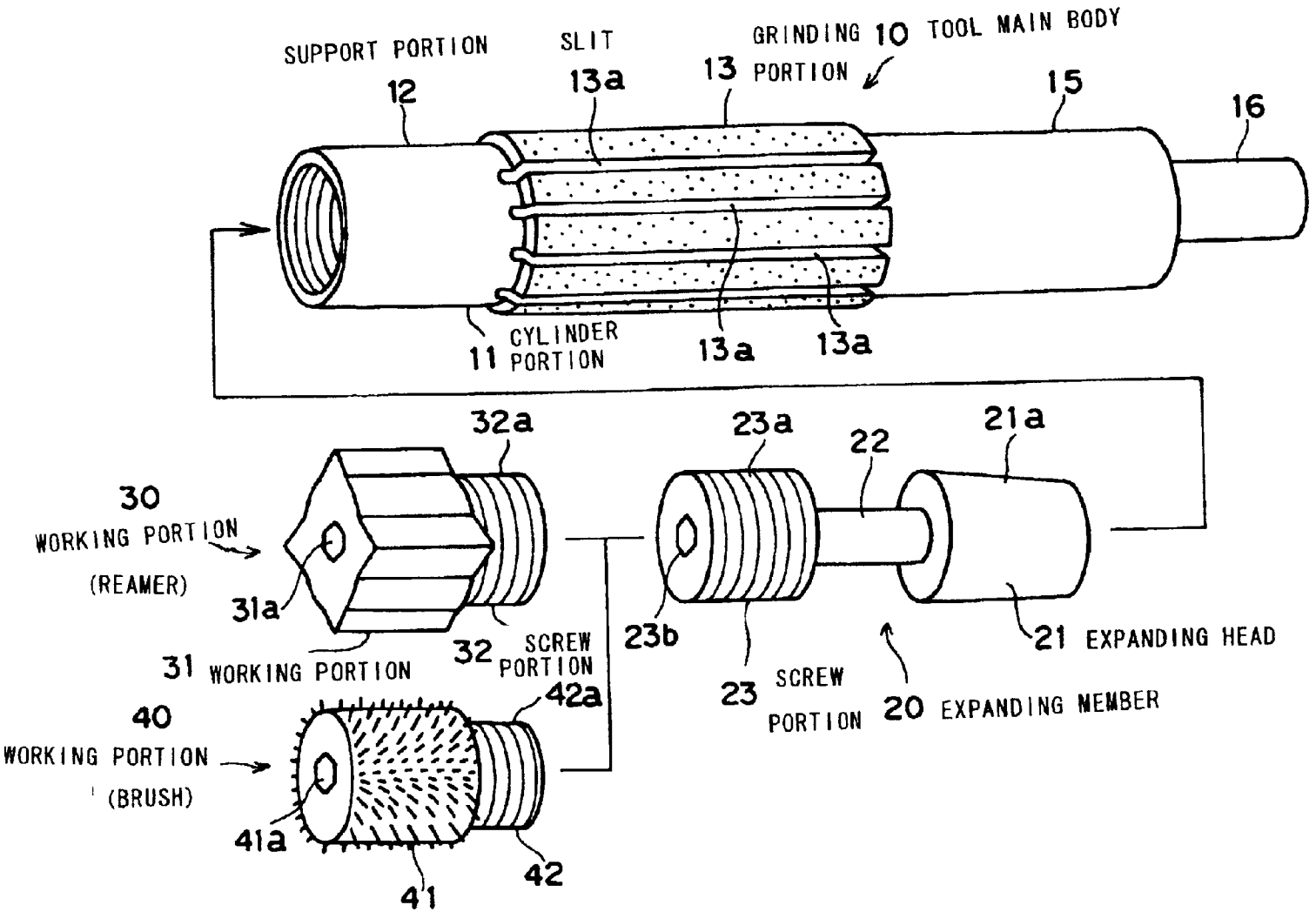
FIG. 1

Exploded perspective view of a grinding tool showing an embodiment in accordance with the present invention.

FIG. 2

Vertical cross-sectional view of the grinding tool.

FIG. 3

FIGS.(*a*) and (*b*) provide schematic views of used states of the grinding tool.

FIG. 4

Vertical cross-sectional view of a conventional grinding tool.

FIG. 5

FIGS. (*a*) and (*b*) provide schematic views of working processes required in case of using the conventional grinding tool.

DESCRIPTION OF REFERENCE NUMERALS

10 TOOL MAIN BODY
11 CYLINDER PORTION
12 SUPPORT PORTION
13 GRINDING PORTION
13*a* SLIT
20 EXPANDING MEMBER
21 EXPANDING HEAD
23 SCREW PORTION
30, 40 WORKING MEMBER
31, 41 WORKING PORTION
32, 42 SCREW PORTION
50 SUBJECT TO BE WORKED
51 ROUND HOLE

DETAILED DESCRIPTION OF THE PRESENT INVENTION

Embodiment

A description will be given of an embodiment in accordance with the present invention with reference to the accompanying drawings. FIG. 1 is an exploded perspective view of a grinding tool showing an embodiment in accordance with the present invention, FIG. 2 is a vertical cross-sectional view of the grinding tool, and FIGS. 3(*a*) and (*b*) are a schematic view of a used state of the grinding tool.

Figure 2:
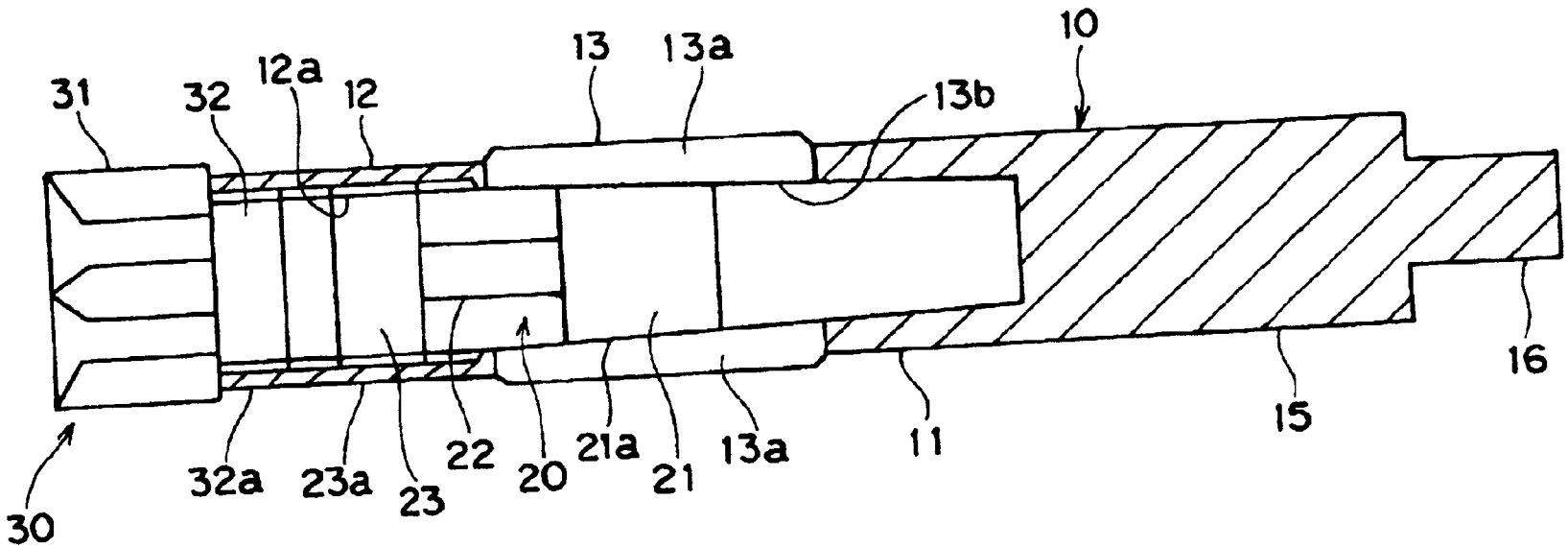

A grinding tool in accordance with the present embodiment is provided with a tool main body 10 in which a portion from a front end portion to a middle portion is formed in a cylindrical shape, an expanding member 20 inserted within a cylinder portion 11 of the tool main body 10, and two types of working members 30, 40 are selectively installed in the front end portion of tool main body 10, as shown in FIGS. 1 and 2.

A support portion 12 and a grinding portion 13 are sequentially provided in the cylinder portion 11 of the tool main body 10 from a front end portion to a rear end portion. The inner surface of the support portion 12 has a slightly larger diameter than that of the inner surface of the other portions, and a female screw portion 12*a* is provided on the inner surface thereof. That is, the support portion 12 corresponds to a nut portion.

A plurality of slits 13*a* extending in the axial direction is provided in the grinding portion 13 at a predetermined interval in a circumferential direction. The grinding portion 13 can be expanded by the slits 13*a*. Abrasive grains such as diamond powders or the like are adhered to the outer surface of the grinding portion 13. The outer surface of the grinding portion 13 has a slightly larger diameter than that of the other portions. The inner surface of the grinding portion 13 is formed in a taper surface 13*b* in which the inner diameter is gradually reduced toward the rear end side.

The rear end side of the cylinder portion 11 corresponds to a first shaft portion 15 having a large diameter, and a second shaft portion 16 having a small diameter is provided further in the rear end side. The second shaft portion 16 corresponds to a connecting portion to a drive mechanism.

An expanding member 20 inserted within the cylinder portion 11 has an expanding head 21 press-fitted within the grinding portion 13 and an screw portion 23 connected to the front end side of the expanding head 21 through the small diameter connecting portion 32. The outer surface of the expanding head 21 is formed in a taper surface 21*a* corresponding to the taper surface 13*b* formed on the inner surface of the working portion 13.

The outer diameter of the screw portion 23 is slightly larger than the maximum diameter of the expanding head 21, and the outer surface is provided with male screw portion 23*a* matching female screw portion 12*a* of the support portion 12. In other words, the screw portion 23 is a large diameter bolt portion to screw into the support 12 having a nut shape. A hexagonal hole 23*b* to which a hexagonal wrench is inserted is provided on a central portion of the front end surface of the screw portion 23.

The working member 30 which is provided at the front end of the tool main body 10 is a grinding reamer. The front portion of the working member 30 is the working portion 31 on which the outer surface is provided with a lathe for grinding, and the rear portion is the screw portion 32 to screw in the nut-shape support portion 12 of the tool main body 10. The outer diameter of the working portion 31 is larger than the outer diameter of the support portion 12, and about the same as the outer diameter of the grinding portion 13. The outer surface of the screw portion 32 has the male screw portion 32*a* matching the female screw portion 12*a* of the support portion 12. A hexagonal hole 31*a* to which a hexagonal wrench is inserted is provided on a central portion of front end surface of the working portion 31.

The other working member 40 provided at the front end portion of the tool main body 10 is a rotating brush. The front portion of the working member 40 is a working portion 41 consisting of a metal brush, and its outer diameter is larger than the outer diameter of the grinding portion 13. The rear portion of the working member 40 is a male screw portion 42 to screw in the nut-shape support portion 12 of the tool main body 10 the same as the screw portion 32 for working member 30. The outer surface is provided with the male screw portion 42*a* matching the female screw portion 12*a* of the support portion 12. A hexagonal hole 41*a* to which a hexagonal wrench is inserted is provided on a central portion of front end surface of the working portion 41.

Next, a description will be given of a use method and a function of the grinding tool in accordance with the present embodiment.

Figure 3:
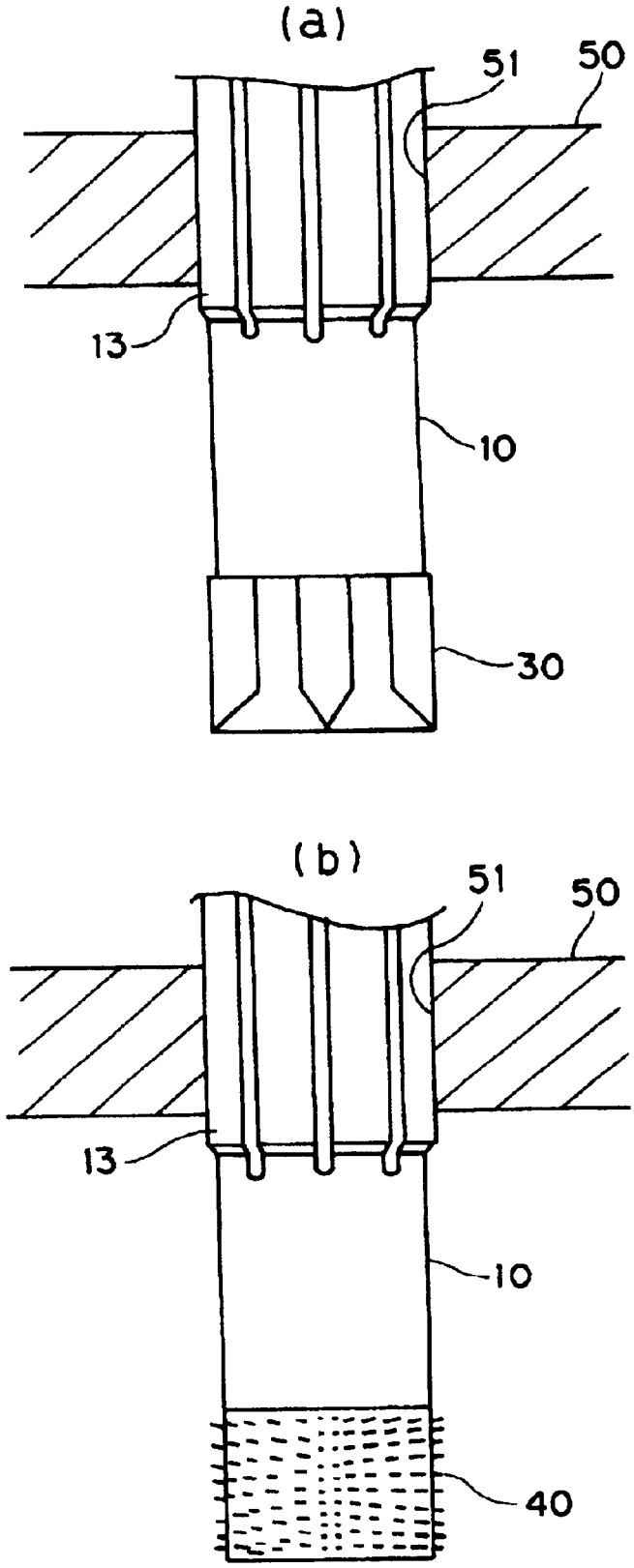
Figure 4:
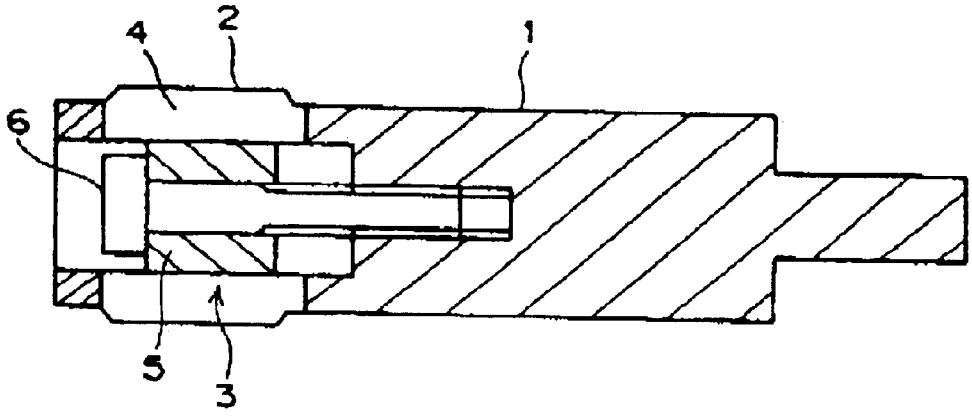
Fig 4 PRIOR ART
Figure 5:
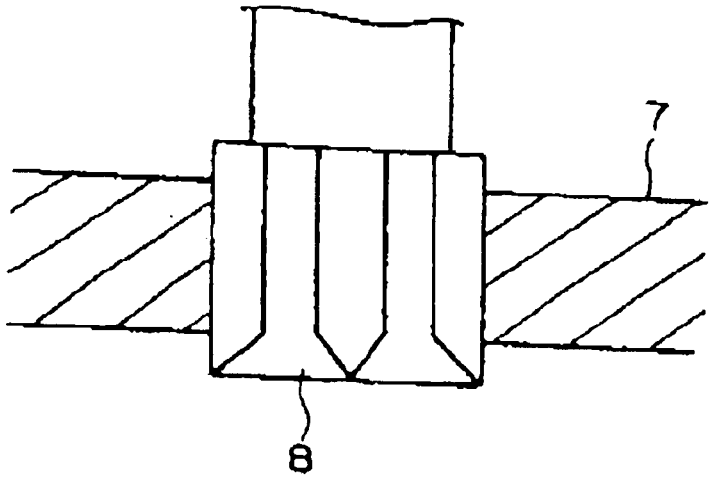
Figure 5:
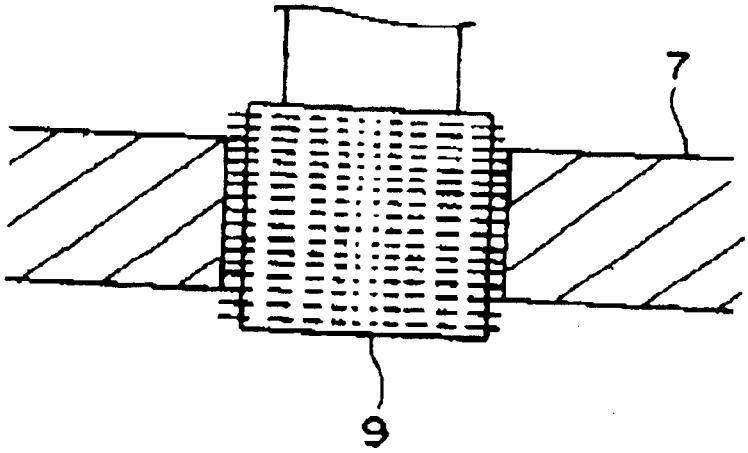

The grinding tool in accordance with the present embodiment is used for a series of processes consisting of the inner surface grinding performed for the purpose of finishing the inner diameter of a round hole 51 provided so as to penetrate through a subject to be worked 50, and inner grinding after creating the hole, or brushing the inner surface after the inner grinding, in one continuous process as shown in FIGS. 3(*a*) and (*b*).

At the time of use, first the expanding member 20 is inserted within the cylinder portion 11 of the tool main body 10, and the screw portion 23 thereof is screwed into the support portion 12 of the tool main body 10. Due to the screwing operation, the expanding head 21 of the expanding member 20 is press-fit into the grinding portion 13, and the grinding portion 13 is expanded. On the basis of an adjustment of the screwing amount, the outer diameter of the grinding portion 13 is adjusted to be equal to or slightly smaller than the inner diameter of the required round hole 41.

After finishing the adjustment of the outer diameter of grinding portion 13, working member 30 or 40 is placed selectively at the front end portion of the tool main body 10.

When creating a hole and grinding the inner surface are performed continuously as shown in FIG. 3(*a*), the screw portion 32 of the working member 30 which is a grinding reamer is screwed into the support portion 12 of the tool main body 10, and the working member 30 is fixed at the front end of the tool main body 10. With this operation, the working portion 31 of the working member 30 is maintained concentrically at the front end side of the tool main body 10.

After finishing attaching the working member 30, the grinding tool is provided with a motor mechanism, and is rotated to move forward. With this forward movement, the round hole 51 is created on the subject to be worked 50 by working portion 31 of the working member 30. The grinding tool moves forward after the round hole 51 is created, and the grinding portion 13 of the tool main body 10 is inserted in the round hole 51. With this continuous movement, the inner surface of the round hole 51 is ground in a continuous process after the hole creation process. Thus, the hole creating process and the following inner grinding are performed in one process.

When inner surface grinding and brushing are performed continuously as shown in FIG. 3(*b*), instead of working member 30 which is grinding reamer, working member 40 which is a rotating brush is attached at the front end of the tool main body 10.

After finishing attachment of the working member 40, the grinding tool is provided with a motor mechanism, and the grinding portion 13 of the tool main body 10 is inserted into the round hole 51 of the subject to be worked 50 while grinding tool is rotated. With this operation, the inner surface of the round hole 51 is ground. At this time, the working portion 41 of the working member 40 is inserted into the round hole 51 in advance of the grinding portion 13 of the tool main body 10, and the inner surface of the round hole 51 is brushed; however, this brushing does not affect the following inner grinding. Rather, the operation removes foreign objects attached to the inner surface of the round hole 51 after hole creation process.

After finishing the inner grinding of the round hole 51 by the grinding portion 13 of the tool main body 10, the grinding tool is removed while rotation continues. With this operation, the inner surface of the round hole 51 which has finished being ground is brushed by the working portion 41 of the working member 40, and grinding powder is removed. Thus, the grinding process and the following inner brushing are performed in one process.

The support portion 12 of the tool main body 10 is used for both the support of the working member 30 and 40, and the support of the expanding member 20. Support of the expanding member 20 can be performed by a screwing operation into the first shaft portion 15; however, by using the support portion 12 for the support, the mechanism of the tool main body 10 is simplified.

Effect of the Invention

As mentioned above, in the case of the grinding tool according to the present invention, since a removable working member that performs the preceding or following process is attached at the front end portion of the tool main body which performs inner grinding, the processes preceding or following the inner grinding can be done as one process in one continuous operation, thereby enables reduction of processing man-hours and processing time, increasing processing efficiency.

What is claimed is:

1. A grinding tool inserted to a hole provided in a subject to be worked while rotating so as to grind the inner surface of the hole, comprising:

a tool main body including an outer surface along an axial direction, a slitted portion including slits in the axial direction at a predetermined interval in a circumferential direction, abrasive grains adhered to the outer surface of the slitted portion to form a grinding portion, and an expanding member press-fitted within the grinding portion to expand the grinding portion, thereby adjusting the outer diameter of the grinding portion, wherein at least a portion of the tool main body is formed in a cylindrical shape; and a working member including a front portion, a rear portion, and a working portion provided in the front portion of the working member to perform working processes before or after grinding of the inner surface in the subject to be worked, and wherein the rear portion is capable of being combined with the tool main body to be able to be attached thereto and removed therefrom;

wherein a female screw portion is formed in an inner surface of the front end portion of the tool main body, and the working member includes a male screw portion that is capable of being screwed into the female screw portion.

2. The grinding tool according to claim 1, wherein an expanding head is disposed inside the tool main body.

3. The grinding tool according to claim 1, wherein the grinding portion includes an inner surface that includes a tapered surface.

4. The grinding tool according to claim 1, wherein the working member is selected from the group consisting of a grinding reamer and a rotating brush.

5. A grinding tool inserted to a hole provided in a subject to be worked while rotating so as to grind the inner surface of the hole, comprising:

a tool main body in which abrasive grains are adhered to at least a portion of an outer surface thereof such that said portion comprises a grinding portion that includes an inner surface that includes a tapered surface;

an expanding member disposed inside the tool main body; and a working member comprising a front portion and a rear portion wherein a working portion is provided in the front portion to perform working processes before or after grinding of the inner surface in the subject to be worked, and the rear portion is capable of being attached to the tool main body and removed therefrom;

wherein the working member is selected from the group consisting of a grinding reamer and a rotating brush.

6. The grinding tool according to claim 1, wherein the abrasive grains comprise diamond powder.

7. The grinding tool according to claim 1, wherein the slits are parallel to an axial direction of the tool main body.

8. A grinding tool comprising:

a tool main body including a front end portion having a cylindrical shape and a female screw portion formed therein, an outer surface, and abrasive grains adhered to the outer surface to form a grinding portion;

an expanding member press-fitted within the grinding portion and including a male threaded member to expand the grinding portion, and a working member including a front portion comprising a working portion, and a rear portion comprising a male screw portion that is capable of being threaded into and threaded out of the female screw portion of the tool main body front portion.

* * * * *